US008420980B2

(12) United States Patent
Takenouchi

(10) Patent No.: US 8,420,980 B2
(45) Date of Patent: Apr. 16, 2013

(54) CERAMIC HEATER, OXYGEN SENSOR AND HAIR IRON THAT USES THE CERAMIC HEATER

(75) Inventor: Hiroshi Takenouchi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 197 days.

(21) Appl. No.: 12/744,666

(22) PCT Filed: Nov. 25, 2008

(86) PCT No.: PCT/JP2008/071310

§ 371 (c)(1),
(2), (4) Date: Aug. 4, 2010

(87) PCT Pub. No.: WO2009/069579

PCT Pub. Date: Jun. 4, 2009

(65) Prior Publication Data

US 2010/0288746 A1 Nov. 18, 2010

(30) Foreign Application Priority Data

Nov. 26, 2007 (JP) ..... 2007-304307

(51) Int. Cl.

| | |
|---|---|
| ***H05B 1/00*** | (2006.01) |
| ***H05B 3/00*** | (2006.01) |
| ***H05B 11/00*** | (2006.01) |
| ***H05B 3/06*** | (2006.01) |
| ***A45D 1/04*** | (2006.01) |

(52) U.S. Cl.
USPC ..... 219/209; 219/246; 219/222; 219/270; 219/542

(58) Field of Classification Search ..... 219/209, 219/222, 546, 548, 552, 553, 538, 542, 543, 219/611, 270, 537, 229, 544, 541; 338/322, 338/326, 327, 328
See application file for complete search history.

(56) References Cited

U.S. PATENT DOCUMENTS

2007/0221661 A1 9/2007 Nagasako et al. ..... 219/544

FOREIGN PATENT DOCUMENTS

| | | |
|---|---|---|
| JP | 2005-190740 | 7/2005 |
| JP | 2005-332502 | 12/2005 |

*Primary Examiner* — Chuong A. Luu
(74) *Attorney, Agent, or Firm* — DLA Piper LLP (US)

(57) ABSTRACT

The conventional lead member had a constant thickness in a section parallel to a longitudinal direction, so that it has found it difficult to enlarge a joint area with a soldering material. Therefore, the lead member itself has to be enlarged so as to enlarge the contact area which contributes to the joining property between the lead member and the soldering material. In a section parallel to the longitudinal direction of a lead member (11) and containing the center axis (A) of the lead member (11), the distance from one point (X) of the soldered portion of the outer circumference of the lead member (11) to the center axis (A) of the lead member (11) is made shorter than the distance from another point (Y) of the soldered portion to the center axis (A), so that the contact area between the lead member (11) and the soldering material can be enlarged.

11 Claims, 5 Drawing Sheets

CERAMIC HEATER, OXYGEN SENSOR AND HAIR IRON THAT USES THE CERAMIC HEATER

CROSS-REFERENCE TO THE RELATED APPLICATIONS

This application is a national stage of international application No. PCT/JP2008/071310, filed on Nov. 25, 2008 and claims the benefit of priority under 35 USC 119 to Japanese Patent Application No. 2007-304307, filed on Nov. 26, 2007, the entire contents of which are incorporated herein by reference.

TECHNICAL FIELD

The present invention relates to a ceramic heater that is used in oxygen sensor, air-fuel ratio sensor, glow plug, hair iron and the like.

BACKGROUND ART

Ceramic heaters are used in such applications as heat source for starting an engine, auxiliary heat source for room air heater and heater of air-fuel ratio sensor. An example of ceramic heater used in these applications is a ceramic heater that has such a constitution as shown in Patent Document 1, where a heating resistor is embedded in a ceramic base, and a lead is connected via a brazing material to an external electrode (electrode pad) that is electrically connected to the end of the heating resistor.

Patent Document 1: Japanese Unexamined Patent Publication (Kokai) No. 2005-332502

DISCLOSURE OF THE INVENTION

Problems to be Solved by the Invention

The ceramic heater used in the applications described above is subjected to stress such as tension and torsion caused by repetitive thermal cycle and/or vibration during operation. When the ceramic heater receives intense stress repetitively, the interface between the external electrode and the lead that is bonded together by the brazing material is significantly influenced by the stress, which may deteriorate the bonding between the lead and the brazing material. It has recently been required for ceramic heaters to have durability high enough to endure such a harsh operating environment as the temperature is raised at a higher rate or higher temperatures are experienced.

It has been a common practice to form the lead of the conventional ceramic heater with a constant thickness over a section parallel to the axial direction thereof, as described in Patent Document 1. When such a lead is used, the lead must be made larger thereby to increase the bonding area, in order to increase the bonding between the lead and the brazing material.

The present invention has been devised to solve the problem described above, and has an object to provide a ceramic heater that has high durability by increasing the bonding strength between the lead and the brazing material.

Means for Solving the Problems

A first ceramic heater of the present invention includes a ceramic base, a heating resistor embedded in the ceramic base, an external electrode that is disposed on side face of the ceramic base and is electrically connected to the heating resistor, and a lead brazed onto the external electrode, wherein the distance between an one point in the brazed portion of a periphery of the lead and a center axis of the lead is smaller than a distance between another point in the brazed portion and the center axis, in a section of the lead that is parallel to a longitudinal direction of the lead and includes the center axis of the lead.

It is preferable that the lead is drawn out to a side of one end of the ceramic base, and the one point in the brazed portion is located nearer to the side of the one end than the another point. It is also preferable that the lead has a recess in the brazed portion. Further it is more preferable that the recess is filled with a brazing material. It is also preferable that the recess opens toward a side of the ceramic base.

It is also preferable that the lead includes the recess in a plurality. It is more preferable that the lead has the recess in the plurality in one of the section that is parallel to the longitudinal direction and includes the center axis. It is still more preferable that the lead is covered by the brazing material at the end thereof.

A second ceramic heater of the present invention includes a ceramic base, a heating resistor embedded in the ceramic base, an external electrode that is disposed on side face of the ceramic base and is electrically connected to the heating resistor, and a lead brazed onto the external electrode, wherein the lead has recess in a portion thereof, the portion contacting with a brazing material in a section of the lead that is parallel to a longitudinal direction of the lead and includes a center axis of the lead.

A third ceramic heater of the present invention includes a ceramic base, a heating resistor embedded in the ceramic base, an external electrode that is disposed on side face of the ceramic base and is electrically connected to the heating resistor, and a lead brazed onto the external electrode, wherein the lead has protrusion in a portion thereof, the portion contacting with a brazing material in a section of the lead that is parallel to the longitudinal direction of the lead and includes a center axis of the lead.

An oxygen sensor and a hair iron of the present invention are characterized in that any one of the ceramic heaters of the present invention described above is provided.

Effects of the Invention

According to the first ceramic heater of the present invention, the distance between the point in the brazed portion of the periphery of the lead and the center axis of the lead is smaller than the distance between the other point in the brazed portion and the center axis; in the section of the lead that is parallel to the longitudinal direction of the lead and includes the center axis of the lead. As a result, contact area between the lead and the brazing material can be made larger since the thickness of the lead is not constant over the section. Thus it is made possible to increase the bonding strength between the lead and the brazing material, specifically tensile strength and torsional strength. This enables it to achieve high durability even in such an environment as the temperature is quickly raised and lowered repetitively, or the temperature is repetitively raised and lowered by a great amount.

According to the second ceramic heater of the present invention, the lead has the recess in the portion thereof that makes contact with the brazing material in the section of the lead that is parallel to the longitudinal direction of the lead and includes the center axis of the lead. Since the lead has the recess, the portion of the brazing material that makes contact with the recess of the lead catches the lead so as to restrict the lead from moving toward either one or the other side in the direction of the center axis, resisting the tensile stress of the lead acting toward either one or the other side in the direction of the center axis of the lead. As a result, bonding between the lead and the brazing material can be further improved.

According to the third ceramic heater of the present invention, the lead has the protrusion in the portion thereof that makes contact with the brazing material in the section of the lead that is parallel to the longitudinal direction of the lead and includes the center axis of the lead. Since the lead has the protrusion, the protrusion hooks onto the brazing material so as to restrict the lead from moving toward either one or the other side in the direction of the center axis, resisting the tensile stress of the lead acting toward either one or the other side in the direction of the center axis of the lead. As a result, reliability of bonding between the lead and the brazing material can be further improved.

The oxygen sensor of the present invention is provided with any one of the ceramic heaters of the present invention described above, and is therefore capable of supplying power stably to the heating resistor even when used at higher temperatures. This is because bonding strength between the lead and the brazing material can be improved and therefore high durability can be maintained even when subjected to high stress caused by thermal expansion during use at high temperatures.

The hair iron of the present invention is provided with any one of the ceramic heaters described above that has improved bonding strength between the lead and the brazing material and is therefore capable of supplying power stably to the heating resistor. As a result, high durability can be maintained even when the temperature is quickly raised and quickly lowered.

BEST MODE FOR CARRYING OUT THE INVENTION

Embodiments of the ceramic heater of the present invention will be described below with reference to the accompanying drawings.

FIG. 1(*a*) is a perspective view showing an example of the embodiment of the ceramic heater of the present invention, and FIG. 1(*b*) is an enlarged perspective view of external electrode (electrode pad) and the surrounding thereof of the ceramic heater according to the embodiment shown in FIG. 1(*a*). FIG. 2(*a*) is an enlarged sectional view in a section parallel to the longitudinal direction of a lead of the ceramic heater according to the embodiment shown in FIG. 1, and FIG. 2(*b*) is an enlarged sectional view of the lead according to the embodiment shown in FIG. 2(*a*).

As shown in FIG. 1 and FIG. 2, the ceramic heater 1 of this example comprises a ceramic base 3, a heating resistor 5 embedded in the ceramic base 3, electrode pads 7 that are disposed on the side face of the ceramic base 3 and are electrically connected to the heating resistor 5 and the lead 11 that are brazed onto the electrode pads 7 via a brazing material 9.

The heating resistor 5 is connected to a lead-out pattern 13 embedded in the ceramic base 3. The lead-out pattern 13 is connected to the electrode pad 7 via a through hole conductor 15 that is provided on the inner surface of a through hole 3*a* which is formed in the ceramic base 3. The heating resistor 5 and the electrode pads 7 are electrically connected to each other in this way.

As shown in FIG. 2, in the ceramic heater 1 of this example, the distance L1 between one point X in the brazed portion of the periphery of the lead 11 and the center axis A of the lead 11 is smaller than the distance L2 between the other point Y in the brazed portion and the center axis A, in a section of the lead 11 that is parallel to the longitudinal direction of the lead 11 and includes the center axis A. In this way the lead 11 of the ceramic heater 1 of this embodiment has portions of different thicknesses in the section thereof that is parallel to the longitudinal direction and includes the center axis A. Therefore, the surface area (or the circumferential length of the section parallel to the longitudinal direction and includes the center axis of the lead) can be made larger for a given sectional area than that of the conventional lead. As a result, contact area between the lead 11 and the brazing material 9 can be increased, so as to increase the bonding strength between the lead 11 and the brazing material 9.

The center axis A of the lead 11 refers to the axis parallel to the longitudinal direction of the lead 11 passing through the center of the figure formed by the profile when the lead 11 is viewed from the side of the end face, and is the axis that passes through the center of the figure in case the figure formed by the profile is circle. In case the figure formed by the profile is square, rectangle or parallelogram, the center axis is the line that passes the intersect of diagonals. When the figure is a trapezoid, the center axis is the line that passes the mid point of the line segment that is at the same distance from the upper base and the lower base. When the figure is an ellipse, the center axis is the line that passes the mid point between two foci.

The distance L1 between one point X in the brazed portion and the center axis A of the lead 11 means the length of a line segment drawn perpendicularly from one point X to the center axis A, when viewing the section that is parallel to the longitudinal direction of the lead and includes the center axis A of the lead 11. Similarly, the distance L2 between the other point Y in the brazed portion and the center axis A of the lead 11 means the length of a line segment drawn perpendicularly from the other point Y to the center axis A, In case the lead of the ceramic heater has a constant thickness over a section that is parallel to the longitudinal direction of the lead and includes the center axis A as in the case of the conventional ceramic heater, the lead can easily move in the direction of the center axis. In the lead 11 of this embodiment, in contrast, since the distance L1 between one point X in the brazed portion and the center axis A of the lead 11 is smaller than the distance L2 between the other point Y in the brazed portion and the center axis A, a stepped portion is formed between one point X and the point Y on the surface of the lead 11. As the stepped portion hooks onto the brazing material 9 to exert mechanical resistance to the tensile stress of the lead 11, the lead 11 is restricted from moving in the direction of center axis A. Since the bonding strength between the lead 11 and the brazing material 9 can be improved in this way, reliability of bonding between the lead 11 and the brazing material 9 can be improved.

FIG. 3(*a*) to FIG. 3(*c*) are respectively enlarged sectional views showing another example of the embodiment of the ceramic heater 1 of the present invention. A preferable shape of the section that is parallel to the longitudinal direction of the lead 11 and includes the center axis A is exemplified by such a shape as the lead 11 has a smaller thickness at an end thereof in the section that is parallel to the longitudinal direction of the lead 11 and includes the center axis A, as shown in FIG. 3(*a*). When the lead 11 has a smaller thickness at the end thereof, it becomes easier to process due to the simple shape and the surface area can be increased. Also because the stepped portion is formed, even when peel-off occurs between the brazing material 9 and the lead 11 due to crack, the crack is effectively prevented by the stepped portion from growing, so that the pee-off does is suppressed from proceeding.

Similarly, FIG. 3(*b*) shows such a shape as the lead 11 has a larger thickness at an end thereof in the section that is parallel to the longitudinal direction of the lead 11 and includes the center axis A. When the lead 11 has a larger thickness at the end thereof, it is made possible to not only increase the surface area but also increase the mechanical strength. This is because even when the lead 11 is pulled toward the side where it is lead out of the brazing material 9 (to the right in FIG. 3(*b*)), the brazing material 9 hooks onto the end portion since the end portion is made thicker.

Further as shown in FIG. 3(*c*), it is more preferable that the bonding portion between the lead 11 and the brazing material 9 has a protrusion 21 in the section that is parallel to the longitudinal direction and includes the center axis A. This configuration makes the surface area larger than that of the embodiments shown in FIG. 3(*a*) and FIG. 3(*b*). As the protrusion 21 is provided, the protrusion 21 hooks onto the brazing material 9 so as to restrict the lead 11 from moving in the direction of the center axis A, resisting the tensile stress of the lead 11 acting toward either one and/or the other side in the direction of the center axis A. As a result, reliability of bonding between the lead 11 and the brazing material 9 can be further improved.

It is preferable that ratio R2/R1 is 1.1 or larger, where R1 is the mean distance between portions of the lead 11, excluding the protrusion 21, and the center axis A, and R2 is the distance between the apex of the protrusion 21 and the center axis A. Providing the protrusion 21 having such a height makes it possible to achieve the effect of the protrusion 21 to hook more reliably. The mean distance between portions of the lead 11, excluding the protrusion 21, and the center axis A may be determined by averaging the distances of ten points randomly selected in the surface excluding the protrusion 21 in the section that is parallel to the longitudinal direction of the lead 11 and includes the center axis A.

FIG. 4(*a*) and FIG. 4(*b*) are respectively sectional views showing another example of the embodiment of the ceramic heater according to the present invention. As shown in FIG. 4, it is preferable that the lead 11 has recess 17 in a portion thereof that is bonded with the brazing material 9, in the section that is parallel to the longitudinal direction and includes the center axis A. Forming the recess 17 in the lead 11 in this way makes it possible to further increase the bonding area between the lead 11 and the brazing material 9.

Forming the recess 17 in the lead 11 also makes it possible to suppress the lead 11 from peeling off completely from the brazing material 9. This is because, even when peel-off occurs in part of the bonding interface due to stress generated in the bonding interface between the brazing material 9 and the lead 11 because of a crack, the crack is effectively prevented by the recess 17 from growing, so that the pee-off does not proceed because the recess 17 has a smaller radius of curvature than the rest of the surface of the lead 11. As a result, it is made possible to suppress the lead 11 from peeling off completely from the brazing material 9, so that power can be supplied stably to the heating resistor 5.

It is also preferable that the recess 17 is filled with a filler material 19 that has a property of bonding well with both the lead 11 and the brazing material 9. Providing the filler material 19 makes it possible to further improve bonding between the lead 11 and the brazing material 9. The filler material 19 may be borosilicate glass, lead glass, gold, silver, platinum, copper, ruthenium oxide, aluminum, nickel, tungsten, covar, inconel, tantalum, etc.

It is preferable that the filler material 19 has high electrical conductivity. Since bonding between the lead 11 and the brazing material 9 is high in the recess 17, flow of electric current between the lead 11 and the brazing material 9 is stabilized by providing the filler material 19 that has high electrical conductivity in the recess 17. As such a filler material 19, gold, silver, platinum, copper, ruthenium oxide, aluminum, nickel, tungsten or tantalum may be used among the materials described above.

It is preferable that the filler material 19 has thermal expansion coefficient of an intermediate value between those of the brazing material 9 and the lead 11. Since the brazing material 9 and the lead 11 generally have different thermal expansion coefficients, stress is generated in the interface between these members due to thermal expansion when the ceramic heater 1 is operated to heat. However, stress generated in the recess 17 due to thermal expansion can be mitigated by using the filler material 19 as described above. This makes it possible to increase bonding between the lead 11 and the brazing material 9 in the recess 17. As such a filler material 19, for example, covar or inconel may be used.

Further, as shown in FIG. 4(*b*), it is more preferable that the recess 17 is filled with the brazing material 9, since it further increases the bonding area between the lead 11 and the brazing material 9. Filling the recess 17 of the lead 11 with the filler material 19 also achieves higher anchoring effect as the brazing material 9 serves as the wedge.

It is preferable that the ratio R2/R1 is 0.9 or less, where R1 is the mean distance between portions of the lead 11, excluding the recess 17, and the center axis A, and R2 is the distance between the bottom of the recess 17 and the center axis A. Providing the recess 17 that recedes significantly makes it possible to achieve the effect of the recess 17 to hook more reliably. The mean distance between portions of the lead 11, excluding the protrusion 21, and the center axis A may be determined by averaging the distances of ten points randomly selected in the surface excluding the recess 17 in the section that is parallel to the longitudinal direction of the lead 11 and includes the center axis A.

It is also preferable that the recess 17 has a curved surface as shown in FIG. 4. This is because stress can be suppressed from being concentrated when the recess 17 has a curved surface and no sharp portion is formed thereon. In particular, it is more preferable that the recess 17 has a semi-spherical surface.

As shown in FIG. 4(*b*), it is preferable that the lead 11 has the recess 17 that opens on the side of the ceramic base 3. This makes it easy to fill the recess 17 with the brazing material 9, so that the recess 17 can be more reliably filled with the brazing material 9. This makes it possible to provide the lead 11 with the brazing material 9 that stably fills, without using a large amount of the brazing material 9. As a result, the ceramic heater having higher durability can be provided.

It is more preferable that the lead 11 has the recess 17 in the brazed portion in the section that is parallel to the longitudinal direction and includes the center axis A, and the recess 17 has a concave shape in the section of the lead 11 that is perpendicular to the longitudinal direction of the lead 11. While the lead 11 is stressed in the direction of rotating around the center axis A, providing the recess 17 having the shape described above increases the resistance to the stress acting in the rotating direction.

In particular, when the recess 17 is filled with the brazing material 9, it is made possible to cause the brazing material 9 to serve as the wedge that resists the stress acting in the direction parallel to the longitudinal direction of the lead 11, and also to serve as the wedge that resists the stress acting in the rotating direction of the lead 11. This greatly improves the reliability of bonding between the lead 11 and the brazing material 9.

FIG. 5(*a*) and FIG. 5(*b*) are respectively enlarged sectional views showing another example of the embodiment of the ceramic heater 1 according to the present invention. As shown in FIG. 5(*a*) and FIG. 5(*b*), it is preferable that the lead 11 has a plurality of recesses 17. This is because, when the lead 11 has a plurality of recesses 17, the bonding area between the lead 11 and the brazing material 9 can be further increased. Providing a plurality of recesses 17 also results in the formation of a plurality of protrusions of the brazing material 9 that serve as wedges, so as to achieve higher anchoring effect. Also because the stress generated in the bonding interface between the lead 11 and the brazing material 9 can be dispersed in the recesses 17, durability can be further improved.

Also as shown in FIG. 5(*a*) and FIG. 5(*b*), it is preferable that the lead 11 has a plurality of recesses 17 in the section that is parallel to the longitudinal direction and includes the center axis A. This is because it is made possible to have the recesses 17 act together when large stress is applied in the direction parallel to the longitudinal direction of the lead 11.

Also as shown in FIG. 5(*a*) and FIG. 5(*b*), it is preferable that the lead 11 makes contact with the brazing material 9 on the end face thereof. When the end face of lead 11 makes contact with the brazing material 9, the portion of the brazing material 9 in contact with the end face of lead 11 serves as a barrier that suppresses the lead 11 from moving toward the other end of the ceramic base 3. As a result, the force that mechanically fastens the lead 11 increases, so that reliability of bonding between the lead 11 and the brazing material 9 can be further improved.

Furthermore, as shown in FIG. 2(*a*) and FIG. 5(*b*), it is preferable that the lead 11 is covered by the brazing material 9 on the end portion thereof. When the lead 11 is covered by the brazing material 9 in this way, the lead 11 can be suppressed from peeling off the brazing material 9 in a direction opposite to the ceramic base 3.

A method for manufacturing the ceramic heater 1 of the present invention will be described below.

The ceramic base 3 can be formed from ceramics that has insulating property. Specifically, oxide ceramics, nitride ceramics and carbide ceramics can be used. More specifically, alumina ceramics, silicon nitride ceramics, aluminum nitride ceramics and silicon carbide ceramics can be used. In particular, from the view point of anti-oxidation property, it is preferable to use alumina ceramics.

A ceramic slurry prepared by adding 4 to 12% by weight in total of sintering aid such as $SiO_2$, CaO, MgO and $ZrO_2$ to the ceramic material described above is formed into a sheet, thereby making a ceramic sheet. The ceramic slurry may be constituted from 88 to 95% by weight of $Al_2O_3$, 2 to 7% by weight of $SiO_2$, 0.5 to 3% by weight of CaO, 0.5 to 3% by weight of MgO and 1 to 3% by weight of $ZrO_2$.

The $Al_2O_3$ content is preferably from 88 to 95% by weight as described above. This is because keeping the content thereof of 88% by weight or more enables it to suppress the concentration of glass component so as to suppress migration from occurring when electric current flows therein. Restricting the $Al_2O_3$ content to 95% by weight or less enables it to disperse a sufficient amount of glass component in the heating resistor 5.

The ceramic base 3 may have, for example, cylindrical shape measuring about 2 to 20 mm in diameter and 40 to 60 mm in length. For the ceramic heater used to heat the air-fuel ratio sensor of automobile, in particular, it is preferable that dimensions of the ceramic base 3 are about 2 to 4 mm in diameter and 40 to 65 mm in length, in order to suppress a portion bonded with the lead 11 from being heated to an extremely high temperature.

An electrically conductive paste that would become the heating resistor 5 and the lead-out pattern 13 are applied by printing or the like onto one principal surface of the ceramic sheet that would become the ceramic base 3. The heating resistor 5 may be formed from a material that has electrical conductivity. Specifically, a material that contains a metal having a high melting point such as W, Mo or Re is preferably used. The electrically conductive paste can be prepared by mixing the metal having a high melting point, a ceramic material, a binder, and an organic solvent and kneading the mixture. The position where heat is generated and the value of electrical resistance can be set as desired by controlling the length of the wraparound pattern of the electrically conductive paste and the width of line that is formed from the electrically conductive paste and would become the heating resistor 5.

Then a through hole 3*a* is formed in the ceramic sheet, and the through hole 3*a* is filled with an electrically conductive material to form a through hole conductor 15. The electrically conductive material may be one that contains at least one of W, Mo and Re as main component. Then the electrode pad 7 is formed on one of the principal surfaces of the ceramic sheet by printing or transfer process. As the material of the electrode pad 7, metals such as W and Ni can be used.

The ceramic sheet is wound around a ceramic core 23 in close contact therewith by using a bonding liquid, to form a cylindrical green compact. The green compact is fired at a temperature from 1,500 to 1,650° C. in a reducing atmosphere.

It is preferable to form a metal plating 25 from a metal such as Ni or Cr on the surface of the electrode pad 7 as shown in FIG. 2, in order to prevent deterioration due to oxidation. The metal plating 25 can be formed, for example, by such a method as electroplating method, electroless plating method, sputtering, thermal spraying or application and drying of a material that contains noble metal particles of sub-micrometer size. It is preferable that the thickness of the metal plating 25 is 1 μm or more so as to suppress the electrode pad 7 from being oxidized. It is also preferable that the thickness of the metal film 25 is 5 μm or less so as to suppress cracks from occurring in the metal plating 25.

Then the lead 11 is bonded onto the electrode pad 7 or the metal plating 25 via the brazing material 9. At this time it is preferable to bond the lead 11 in a reducing atmosphere that contains water vapor. As the brazing material 9, a material containing Au—Cu, Ag, Ag—Cu or the like as the main component may be used. As the lead 11, metals having low electrical resistance such as Ni, Ni alloy, platinum, copper and the like can be used.

The ceramic heater 1 of this embodiment uses the lead 11 that has such a configuration as the distance L1 between one point X in the brazed portion of the periphery of the lead 11 and the center axis A of the lead 11 is smaller than the distance L2 between the other point Y in the brazed portion and the center axis A, in a section that is parallel to the longitudinal direction and includes the center axis A. Using the lead 11 having such a configuration makes it possible to increase the bonding area between the lead 11 and the brazing material 9. Therefore, the strength of the lead 11 against the stress acting in the direction of pulling or rotating can be increased.

The lead 11, as one that has a shape of polygonal prism or the lead 11 of cylindrical shape, can be formed, for example, by pressing or recessing of the brazed portion.

It is preferable to form a plating layer of Au, Cr, Ni or the like further on the surfaces of the electrode pad 7, the brazing material 9 and the lead 11. This is because it enables it to suppress the electrode pad 7, the brazing material 9 and the lead 11 from deteriorating due to oxidization. The thickness of the plating layer is preferably in a range from 1 to 10 μm.

The ceramic heater of the present invention is not limited to the embodiments described above as long as it enables bonding of the lead 11 to the electrode pad 7 via the brazing material 9. Therefore, the ceramic heater can be applied to ceramic heaters of various shapes such as cylinder, plate, etc.

The oxygen sensor of this embodiment will be described below. The oxygen sensor of this embodiment comprises a sensor section that has a solid electrolyte layer, a measurement electrode disposed on one principal surface of the solid electrolyte layer and a reference electrode disposed on the other principal surface of the solid electrolyte layer, and the ceramic heater 1 exemplified by the embodiment described above that is connected to the sensor section. The ceramic heater 1 of the oxygen sensor of this embodiment has high durability as described above. Thus the oxygen sensor of this embodiment is capable of stably measuring the concentration of the gas under measurement. As a result, the oxygen sensor having high reliability can be provided.

The hair iron of this embodiment will be described below. The hair iron of this embodiment has such a constitution as the ceramic heater 1 exemplified by the embodiment described above is secured onto the tip of a heating iron and is connected by the lead 11 to electric circuits such as temperature regulator. Since the hair iron of this embodiment has the ceramic heater 1 exemplified by the embodiment described above, high durability can be maintained even when the hair iron is operated to heat quickly and cool down quickly. The hair iron manufactured as described above can be used as a soldering iron or the like.

EXAMPLES

The ceramic heater of the present invention was fabricated as described below. First, a ceramic green sheet was formed from $Al_2O_3$ as the main component with 10% by weight of $SiO_2$, CaO, MgO and $ZrO_2$ in total added thereto. Then the through hole 3*a* was formed into a ceramic green sheet, and the through hole 3*a* was filled with a paste consisting mainly of W to form the through hole conductor 15. The electrically conductive paste containing W—Re as the main component, that serves as a heating resistor 5, was printed onto the ceramic green sheet by screen printing process. The electrically conductive paste was printed so as to form the heating resistor 5 having length of 5 mm and resistance of 12 to 13Ω after being fired.

Then the electrode pad 7 was formed on the through hole 3*a* using a paste containing W as the main component by screen printing process. This sheet was coated with a bonding liquid that contains ceramics of nearly the same composition as that of the ceramic green sheet. Furthermore, the ceramic green sheet coated with the bonding liquid was wound around a ceramic core 23 in close contact therewith, followed by firing in a reducing atmosphere at a temperature from 1,500 to 1,600° C.

The Ni plating film 25 having a thickness of 2 to 4 μm was formed on the electrode pad 7 by electroplating. Furthermore, the electrode pad 7 and the lead 11 were bonded together by using the brazing material 9 made of Ag—Cu. The lead 11 had a cylindrical shape measuring 0.8 mm in diameter and 20 mm in length. The lead 11 of the ceramic heater 1 of each specimen number was process by pressing in advance, so as to form into the shape shown in Table 1. Each specimen of the ceramic heater 1 had dimensions of 3 mm in diameter and 55 mm in length. The electrode pad 7 measured 5 mm by 4 mm, and the diameter of the through hole was 500 μm.

The ceramic heater 1 fabricated as described above was subjected to a durability test of thermal cycles.

First, the specimen was subjected to 4,000 thermal cycles in a thermostat that was kept at a temperature one half (about 400° C. in the case of a Ag—Cu brazing material) of the melting point of the brazing material 9, each cycle consisting of heating to the temperature described above for 10 minutes and a period of forced cooling with air of 25Ω. After thermal cycles, a tensile strength test was conducted in which the tensile strength of the lead 11 was measured. A torsional strength test was conducted in which the torsional strength of the lead 11 was measured. The tensile strength was measured by securing the ceramic heater and pulling the lead 11 in the vertically direction at a speed of 32 mm/min while measuring the load at the time of rupture with a load cell. The torsional strength was measured by securing the lead 11 to a motor, pulling the lead 11 with a force of 5 N, and running the motor at a speed of 2 turns per minute until the lead 11 is fractured. Test results are shown in Table 1.

TABLE 1

| Specimen No. | Cross section of lead | Number of recesses | Filling recess with brazing material | Position of recess | Covering of brazing material | Tensile strength of the lead after thermal cycle test (N) | State of lead after torsion test |
|---|---|---|---|---|---|---|---|
| 1 | Constant thickness | 0 | — | — | No | 12 | Lead and brazing material peeled off after 1 turns |
| 2 | FIG. 3(c) | 0 | — | — | No | 22 | Lead and brazing material peeled off after 2 turns |
| 3 | FIG. 4(a) | 1 | No | On substrate | No | 38 | Lead and brazing material peeled off after 3 turns |
| 4 | FIG. 4(b) | 1 | Yes | On substrate | No | 44 | Lead and brazing material peeled off after 4 turns |
| 5 | FIG. 5(a) | 2 | Yes | On substrate | No | 83 | Lead and brazing material peeled off after 5 turns |
| 6 | FIG. 5(b) | 2 | Yes | On substrate | No | 108 | Lead and brazing material peeled off after 8 turns |

As shown in Table 1, the ceramic heater 1 of specimen No. 1 showed low tensile strength of 12 N, and particularly low durability in the bonding portion between the lead 11 and the brazing material 9. This is because, in the ceramic heater 1 of specimen No. 1, the lead 11 has a constant thickness over a section that is parallel to the longitudinal direction of the lead 11 and includes the center axis A, and therefore the bonding area between the lead 11 and the brazing material 9 was small that resulted in insufficient anchoring effect. As a result, a gap was formed between the brazing material 9 and the lead 11 and oxidization of the brazing material 9 proceeded in the gap that deteriorated the bonding, due to the difference in thermal expansion between the brazing material 9 and the lead 11 in thermal cycle.

In contrast, in the ceramic heaters 1 of specimen Nos. 2 to 6, where the distance between one point X in the brazed portion of the periphery of the lead 11 and the center axis A of the lead 11 was made smaller than the distance between the other point Y in the brazed portion and the center axis A in a section of the lead 11 that is parallel to the longitudinal direction and includes the center axis A by deforming the lead 11, in contrast, improvement in durability was confirmed in every specimen with tensile strength of 22 N or more.

Close examination of the test results on the specimens showed that the ceramic heater 1 of specimen No. 2, where the sectional shape had protruding end and opening on the side of the ceramic base 3, showed improvement in durability of the bonding section of the lead with tensile strength of 22 N. Durability against the stress in the direction of torsion was also improved so as to endure up to two turns.

The ceramic heater 1 of specimen No. 3, that had opening on the side of the ceramic base 3, the recess 17 formed on the side face of the lead 11 with the recess 17 not filled with the brazing material 9 showed further improvement of durability of the bonding section of the lead with tensile strength of 38 N. Durability against the stress in the direction of torsion was also improved so as to endure up to three turns. The recess 17 of the ceramic heater 1 of specimen No. 3 was not completely filled with the brazing material 9, with glass beads being put into the recess 17 as the filler material 19.

The ceramic heater 1 of specimen No. 4, that had opening on the side of the ceramic base 3, the recess 17 formed on the side face of the lead 11 with the recess 17 being filled with the brazing material 9, showed further improvement of durability of the bonding section of the lead with tensile strength of 44 N, because bonding between the lead 11 and the brazing material 9 was improved by filling the recess 17 with the brazing material 9. Durability against the stress in the direction of torsion was also improved so as to endure up to four turns.

In the ceramic heater 1 of specimen No. 5, the lead 11 had a plurality of recesses 17 as shown in FIG. 5(*a*). As a result, it was confirmed that durability of the bonding section of the lead was improved further with tensile strength of 83 N. Durability against the stress in the direction of torsion was also improved so as to endure up to five turns.

In the ceramic heater 1 of specimen No. 6, the lead 11 had a plurality of recesses 17 as shown in FIG. 5(*b*). In the ceramic heater of specimen No. 6, end of the lead 11 is covered by the brazing material 9. As a result, durability of the bonding section of the lead was improved further with tensile strength of 108 N. Durability against the stress in the direction of torsion was also improved so as to endure up to eight turns.

Figure 1A:
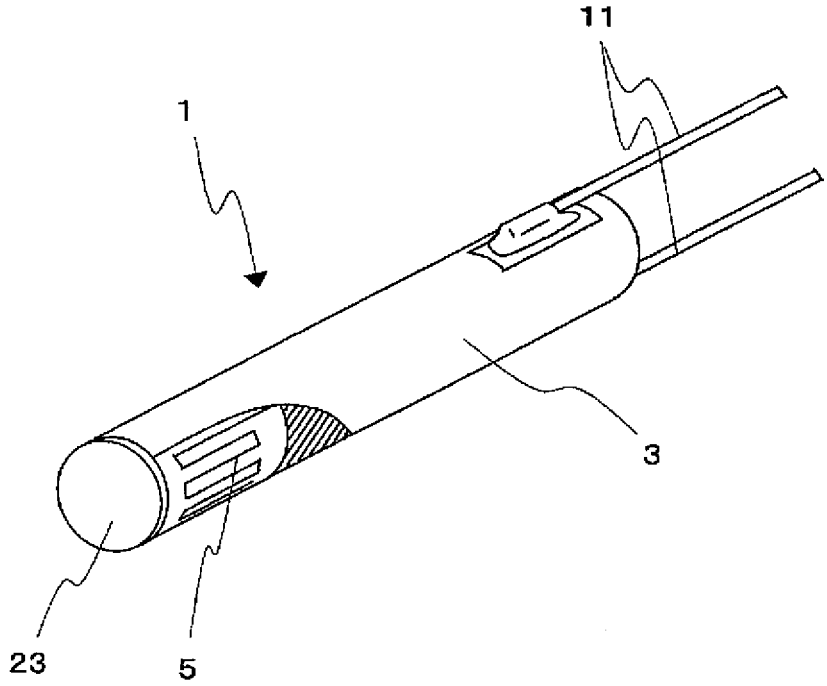
In FIG. 1, FIG. 1(*a*) is a perspective view showing an example of the embodiment of the ceramic heater of the present invention, and FIG. 1(*b*) is an enlarged perspective view of the vicinity of the lead of the embodiment shown in FIG. 1(*a*).
Figure 1B:
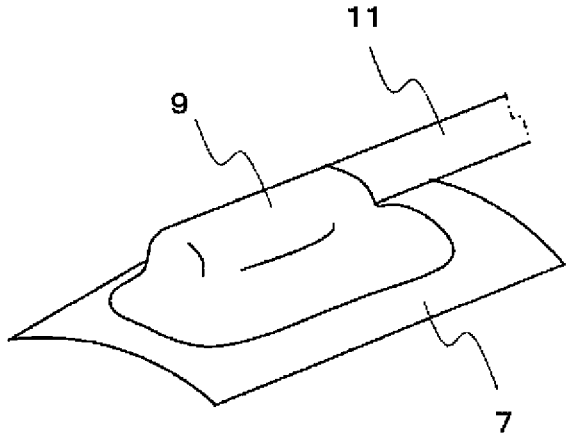
Figure 2A:
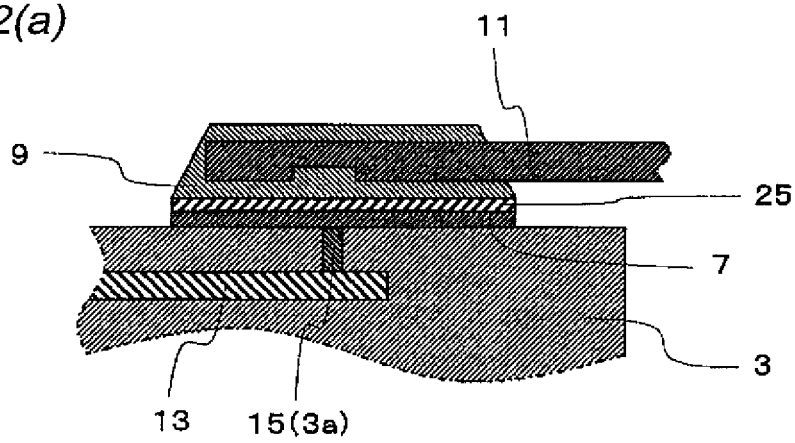
In FIG. 2, FIG. 2(*a*) is an enlarged sectional view in a section in parallel to the longitudinal direction of the lead of the ceramic heater according to the embodiment shown in FIG. 1, and FIG. 2(*b*) is an enlarged sectional view showing the vicinity of the end of the embodiment shown in FIG. 1(*a*).
Figure 2B:
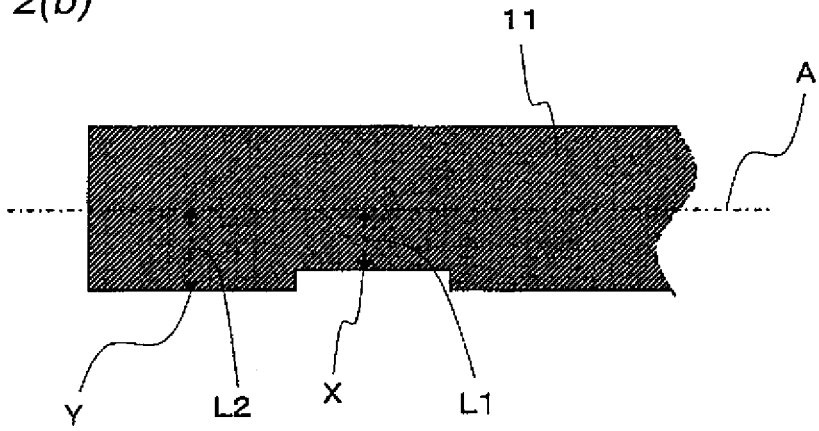
Figure 3A:
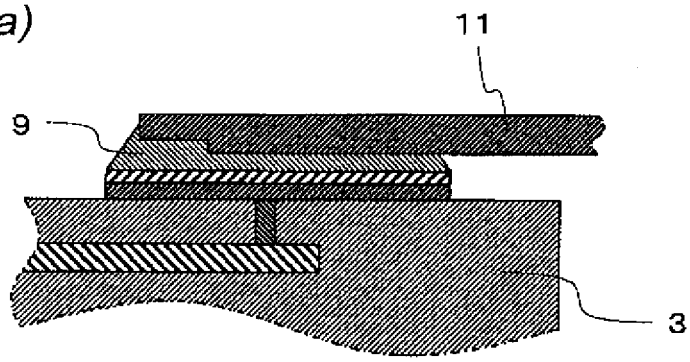
FIG. 3(*a*) to FIG. 3(*c*) are sectional views showing another example of the embodiment of the ceramic heater according to the present invention.
Figure 3B:
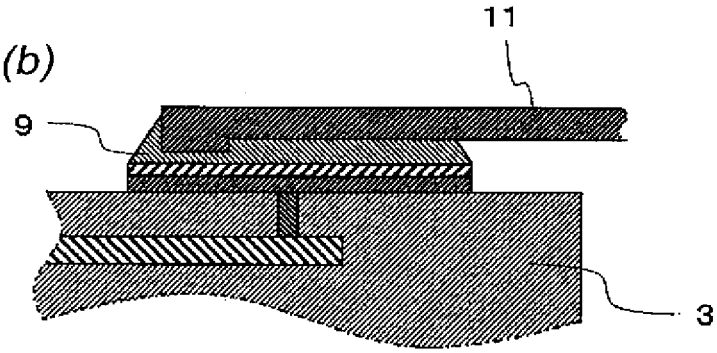
Figure 3C:
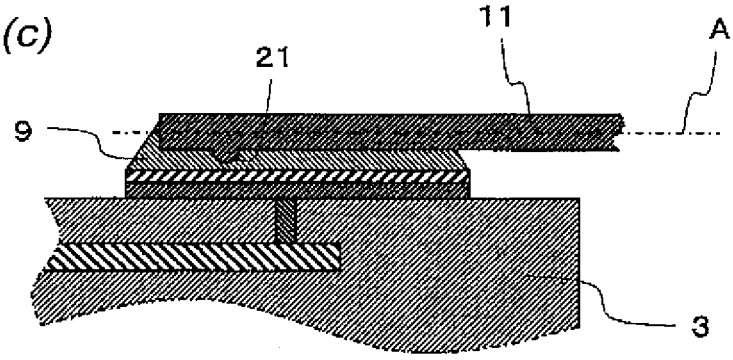
Figure 4A:
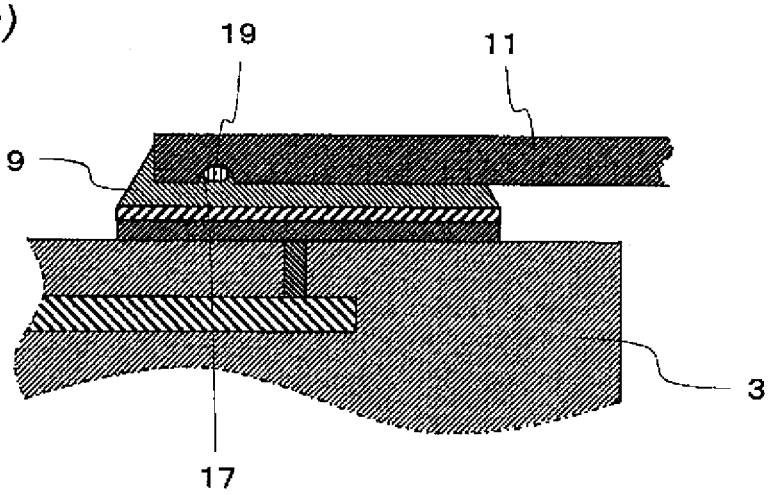
FIG. 4(*a*) to FIG. 4(*b*) are sectional views showing another example of the embodiment of the ceramic heater according to the present invention.
Figure 4B:
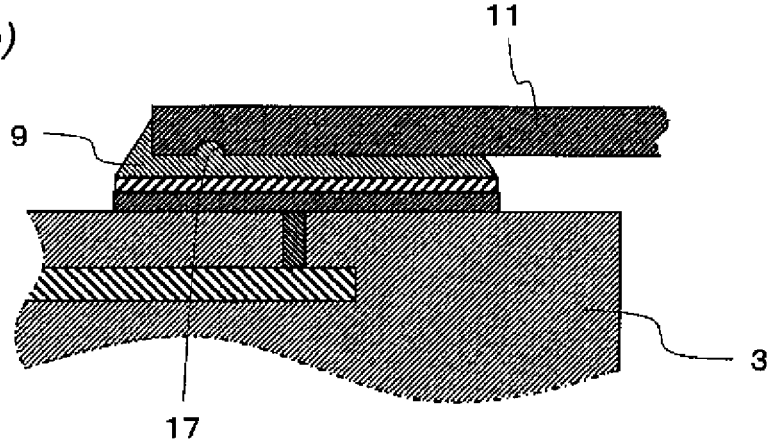
Figure 5A:
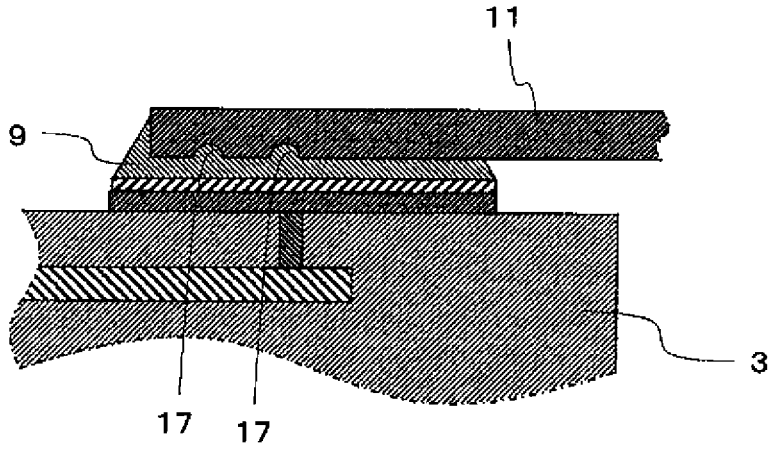
FIG. 5(*a*) to FIG. 5(*b*) are sectional views showing another example of the embodiment of the ceramic heater according to the present invention.
Figure 5B:
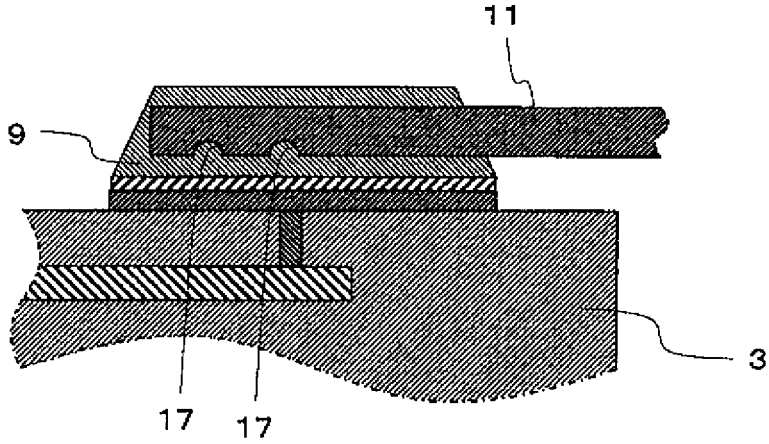

| | |
|---|---|
| 1 | Ceramic heater |
| 3 | Ceramic base |
| 3a | Through hole |
| 5 | Heating resistor |
| 7 | Electrode pad (external electrode) |
| 9 | Brazing material |
| 11 | Lead |
| 13 | Lead-out pattern |
| 15 | Through hole conductor |
| 17 | Recess |
| 19 | Filling material |
| 21 | Protrusion |
| 23 | Ceramic core |
| 25 | Metal film |
| A | Center axis |
| X | One point in the brazed portion |
| Y | The other point in the brazed portion |
| L1 | Length of line segment drawn perpendicularly from one point X to center axis A |
| L2 | Length of line segment drawn perpendicularly from one point Y to center axis A |

The invention claimed is:

1. A ceramic heater comprising:

a ceramic base;

a heating resistor embedded in the ceramic base;

an external electrode that is disposed on side face of the ceramic base and is electrically connected to the heating resistor; and a lead brazed onto the external electrode, wherein a distance between a first point in a brazed portion of a periphery of the lead and a center axis of the lead is smaller than a distance between another point in the brazed portion and the center axis, in a section of the lead that is parallel to a longitudinal direction of the lead and includes the center axis of the lead.

2. The ceramic heater according to claim 1, wherein the lead is drawn out to a side of one end of the ceramic base, and the one point in the brazed portion is located nearer to the side of the one end than the another point.

3. The ceramic heater according to claim 1, wherein the lead comprises a recess in the brazed portion in the section that is parallel to the longitudinal direction and includes the center axis.

4. The ceramic heater according to claim 3, wherein the recess is filled with a brazing material.

5. The ceramic heater according to claim 3, wherein the recess opens toward a side of the ceramic base.

6. The ceramic heater according to claim 3, wherein the lead comprises the recess in a plurality.

7. The ceramic heater according to claim 6, wherein the lead comprises the recess in the plurality in one of the section that is parallel to the longitudinal direction and includes the center axis.

8. The ceramic heater according to claim 1, wherein the lead is covered by the brazing material at an end thereof.

9. A ceramic heater comprising:

a ceramic base;

a heating resistor embedded in the ceramic base;

an external electrode that is disposed on side face of the ceramic base and is electrically connected to the heating resistor; and a lead brazed onto the external electrode, wherein the lead comprises a recess in a portion thereof, the portion contacting with a brazing material, in a section of the lead that is parallel to the longitudinal direction of the lead and includes a center axis of the lead.

10. A hair iron comprising:

the ceramic heater according to claim 1.

11. A hair iron comprising:

the ceramic heater according to claim 9.

* * * * *